United States Patent [19]

Heaton et al.

[11] Patent Number: 5,017,113

[45] Date of Patent: May 21, 1991

[54] FILLETING ATTACHMENT FOR A CAULKING GUN

[76] Inventors: Donald E. Heaton, 18 Brackencrest Rd., St. Catharines, Ontario, Canada, L2P 1S0; John E. Roepke, R.R. #1, Jordan, Ontario, Canada, L0R 1S0

[21] Appl. No.: 352,876

[22] Filed: May 17, 1989

Related U.S. Application Data

[63] Continuation-in-part of Ser. No. 188,852, May 2, 1988, abandoned.

[51] Int. Cl.[5] ..... B28B 3/00

[52] U.S. Cl. ..... 425/87; 222/575; 222/327

[58] Field of Search ..... 222/575, 567, 568, 570, 222/566, 325, 326, 327; 425/87, 458; 401/265, 266

[56] References Cited

U.S. PATENT DOCUMENTS

| | | | |
|---|---|---|---|
| 963,840 | 7/1910 | Whitaker, Jr. | 425/458 |
| 2,559,553 | 7/1951 | Wolff | 401/266 |
| 4,258,884 | 3/1981 | Rogers | 222/570 |
| 4,570,834 | 2/1986 | Ward | 222/566 |

*Primary Examiner*—H. Grant Skaggs
*Assistant Examiner*—Kenneth Noland
*Attorney, Agent, or Firm*—McConnell and Fox

[57] ABSTRACT

A tool is provided to fit on the plastic nozzle of standard caulking cartridges. The tool consists of a tapered hollow body terminated in a planar sqeegee member which has two edges at 45° to the center line of the body. An orifice under the sqeegee permits caulking compound to emerge from the tool where it is shaped into a fillet for sealably joining two surfaces which are at right angles to each other. The sqeegee wipes the surfaces clean except at the junction of the surfaces where the fillet is formed.

10 Claims, 2 Drawing Sheets

FILLETING ATTACHMENT FOR A CAULKING GUN

RELATED APPLICATIONS

This application is a continuation-in-part of application No. 188,852 filed May 2, 1988 by Donald E. Heaton and John E. Roepke now abandoned.

FIELD OF THE INVENTION

This invention relates to tools for forming fillets of extruded material.

DESCRIPTION OF THE PRIOR ART

At the junction of water repellent surfaces, particularly in kitchen and bathroom counters and back splashers where two surfaces join at right angles, it is desirable to produce a leak-proof joint. It has been common to extrude a bead of water-repellent material which is adhesive to the surfaces, such as a silicone compound, at the junction. In order to ensure adherence and to improve the appearance of the junction, it has been usual, in the past, to smooth the bead to form a fillet. While it is suggested that the fillet can be formed by pushing the tip of the extruder away from the formed fillet, in fact, due to the stickiness of the compounds used and their viscosity, the results are usually not particularly desirable. It may be necessary to go over the bead and form the fillet subsequently with a wet finger. All this must be performed before the compound sets since it is impossible to reform the fillet once the material is set.

It is usual that the joint-forming material is provided in a disposable cartridge which in turn is placed in a caulking gun which, by means of a piston, forces the material out of the cartridge through a plastic nozzle attached to the end of the cartridge. It is desired to provide a tool which can be adapted to the standard caulking cartridge and which will properly form the fillet at the intersection of two surfaces at right angles to each other.

SUMMARY OF THE INVENTION

In accordance with the invention, a tool is provided which includes at its end a planar surface which engages, at its edges, the surfaces to be joined. The tool is adapted to sealably engage the plastic nozzle at the end of a standard caulking cartridge. In operation, the compound from the cartridge is forced out through its normal tip into the tool which is of tapered tubular form and includes the planar surface, previously defined, at its tip. The caulking material proceeds down through the tool and out through an orifice under the planar surface of the tool. In operation, the caulking compound is extruded out of the cartridge through the tool and out through the orifice at the end of the tool, while at the same time the tool is moved down the joint which is to be filleted. The edges of the planar surface tightly engage the two surfaces to be joined and prevent the compound from remaining on those surfaces by the wiping action and permit only a fillet of caulking compound to remain at the junction of the two surfaces to be joined, the curved face of the fillet being formed at the curved junction of the two edges of the planar surface at the end of the tool.

A clearer understanding of our invention may be had from consideration of the drawings in which:

DESCRIPTION OF THE PREFERRED EMBODIMENT

Figure 1:
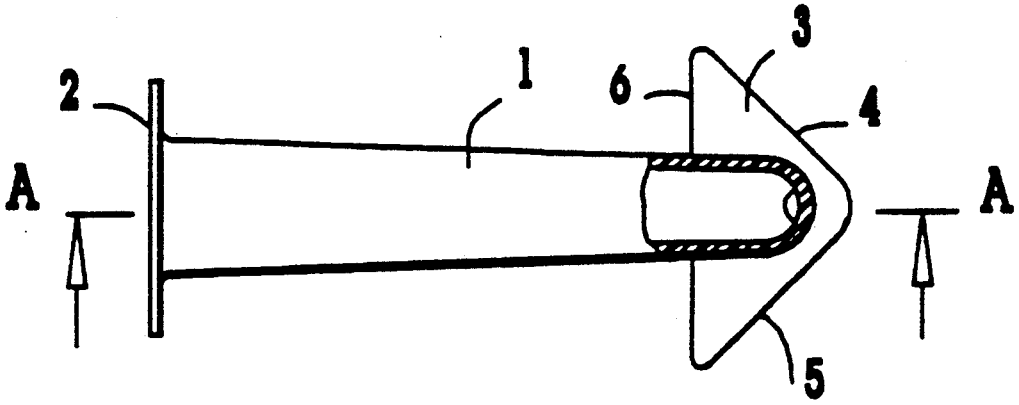
FIG. 1 is a plan view of the tool in accordance with our invention.
Figure 2:
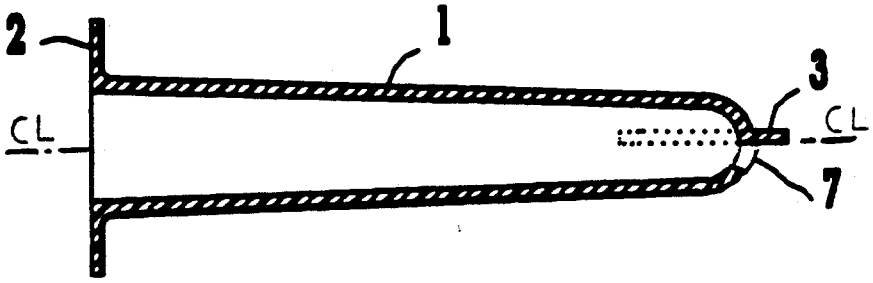
*FIG. 2 is an elevational view at section 2,2 of FIG. 1.*

Considering first FIGS. 1 and 2, it will be seen that the tool itself consists of a tubular body 1 having a tapered section being larger in diameter at the left end which will be termed its base and terminated with a flange 2. The planar surface 3 is molded in a location directly above the centre line shown in FIG. 2. As will be seen, the planar surface consists of an essentially triangular member having two edges 4 and 5 at approximately right angles to each other and the third edge 6 substantially at right angles to the centre line of the tool.

As will be seen in FIG. 2, this planar member does not extend into the interior of body 1 but merely extends from the walls of the body. An orifice 7 is formed in the body below the planar surface at a smaller end of the tubular body, and together with this end of the tubular body and the orifice the tubular body forms a partial closure.

Figure 3:
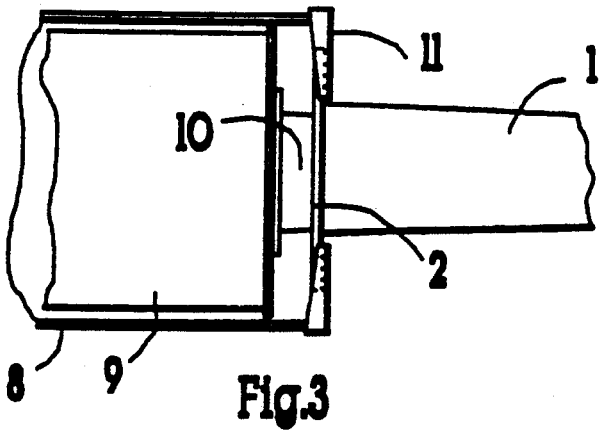
*FIG. 3 is an illustration of the tool in place when* engaged with a caulking cartridge installed in a caulking gun.

Considering now FIG. 3, it will be seen that the caulking gun 8, only a portion of which is shown, contains within it a replaceable cartridge 9 having a plastic nozzle 10 which protrudes from the end of the cartridge. The body 1 of the tool fits over the plastic nozzle 10 and is held in place by the engagement of flange 2 with the front portion 11 of the caulking gun.

OPERATION

In operation, the tool is assembled to the end of the cartridge as shown in FIG. 3 and then placed in the caulking gun. It will be noted that the caulking gun normally includes either a slot or hole in its forward portion 11 of sufficient diameter to accept the body 11 of the tool and yet engage the flange 2. In normal operation, the piston of the caulking gun (not shown) forces the compound within the cartridge through the nozzle of the cartridge 10 and into the interior of the body 1 of the tool. It then is forced out through orifice 7 under the planar surface 3. As will be seen in FIG. 4, the end of the planar surface 3 forms the upper surface of the fillet between the two surfaces to be joined designated 12 and 13. The fillet 14, formed from the caulking compound, fills the junction between the two surfaces 12 and 13. The edges 4 and 5 of the planar surface 3 firmly engage surfaces 12 and 13 and wipe away any excess compound ensuring that, after the tool passes over the joint, the extruded material remains only in the fillet and the remainder is wiped back into the joint by the edges 4 and 5. It is essential that the material of the planar surface 3 be selected to be tough so that during operation there is no undue wearing of the edges 4 and 5 and at the same time be resilient so that it can flexibly engage surfaces 12 and 13 and sqeegee surplus material off the surfaces and into the fillet.

While the thicknesses of the material shown in FIGS. 1 and 2 may be taken as typical, assuming the figures to be lifesize, the actual thicknesses of the material will depend upon the nature of the plastic used. As has been indicated, the body 1 must be sufficiently rigid to maintain pressure of the compound being extruded and also the force applied to the tool by the user, and yet it must not be brittle causing fracture failure in use. The planar surface, on the other hand, must, as has been indicated, be sufficiently thin to be flexible and must operate as a sqeegee. It must therefore not wear unduly during use but must wipe the surfaces clean so that further work is not necessary after the fillet has been formed. Selection of a suitable plastic material will be based on these various criteria and must fit the requirements of both the body 1 and the planar surface 3.

Figure 4:
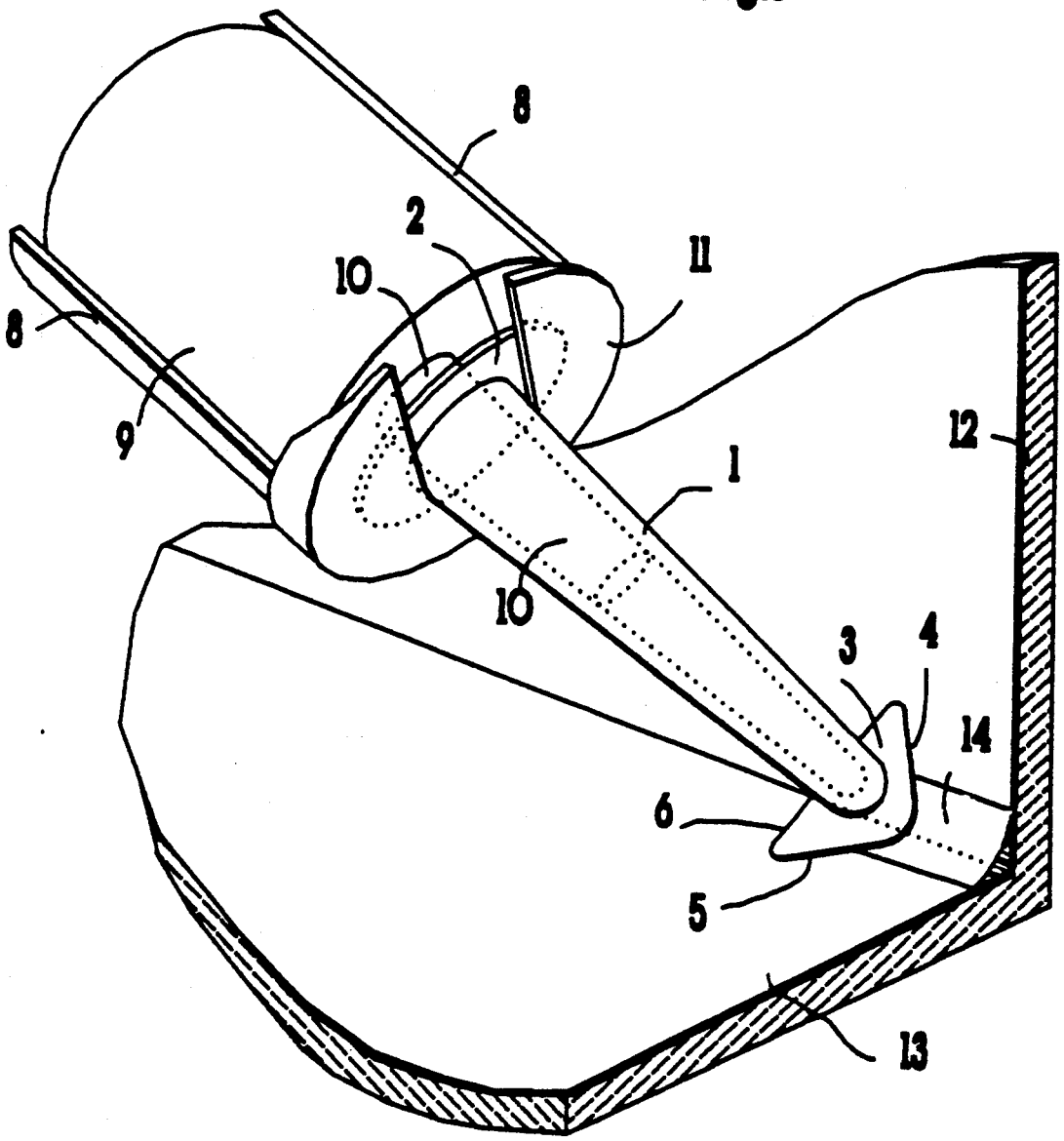
FIG. 4 is a perspective view of the tool in use.

It will be noted that in operation the tool is moved down the fillet in a direction to the left as shown in FIG. 4, while the compound is extruded. The user will normally hold the tool at such an angle that edges 4 and 5 firmly engage the surfaces 12 and 13. This may produce an angle of approximately 45° relative to the line of the joint. While the angles both of the planar surface and of the tool in use are not critical, some small experimentation may be necessary by the user to determine the preferred angle of use depending upon the actual angle between the two edges 4 and 5. The lengths of the edges 4 and 5 are a matter of choice, they must however be sufficiently small that the whole flexible planar surface can be forced through the hole in the end of the caulking gun, if a hole is provided rather than a slot.

As will be seen from FIG. 2, the lower portion of the tool has a radius of curvature different from the upper. It is necessary that the tip of the tool shall not interfere or touch the fillet or the surfaces while in use so that the compound can flow freely from the orifice and the planar surface will be sure to engage both surface 12 and 13 and also the tip of the planar surface will properly engage the caulking material.

The diameter and taper of the interior surface of the tool is selected so that it fits over the plastic nozzle on the end of the cartridge. Since the cartridges are made by various manufacturers, it is necessary to produce a diameter that co-operates with the majority of such various nozzles. It has been found that an interior diameter of 0.625 inches at the flange end of the tool tapering at about 2½ degrees to the end of a 3¼ inch tool, provides the necessary interior diameter to be accepted by the nozzle on the majority of available cartridges, which may be cut by the user to a length suitable to receive the tool.

While the dimensions of the tool in FIGS. 1 and 2 are typical, they should not be viewed as limiting, since various shapes of tool will accomplish the same end as long as the dimensions fall within the limits dictated by normal caulking cartridges, normal caulking guns and convenience of the user. Thus, as has been indicated, the interior diameter at the flange must be acceptable by an average cartridge; the flange must be such as to be accepted by the normal caulking gun and retain the tool in position; the planar surface must be sufficiently flexible to sqeegee the surface and yet wear well and, at the same time, be sufficiently flexible to permit insertion through the end of the caulking gun where the end of the caulking gun terminates in a hole rather than a slot.

Figure 5:
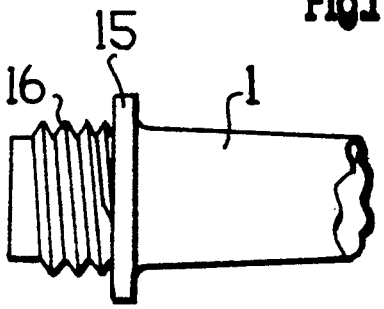
FIG. 5 is an illustration of an alternate form of mounting means for the tool.

The selection of suitable plastic materials will depend upon the production process, but it will be evident that it is desirable that the tool should be made by injection molding. The edges of the planar member 4 and 5 may either be flat or rounded, it is only necessary that they retain their shape to ensure that the proper sqeegee action is performed. While the tool has been shown with a flanged end, it is evident that for some applications the means of retaining the tool on the end of a cartridge may vary. For example, some cartridges are provided with an internally threaded orifice, in which case the end of the tool could be provided with a matching external thread as shown in FIG. 5.

It should also be understood that for some applications, because of space restrictions, it may not be possible to properly position the tool with respect to the surfaces while mounted on the end of a caulking cartridge. In those circumstances, the caulking may be applied as a bead and then formed into a suitable fillet with the tool held in the hand separate from the cartridge.

I claim:

1. A fillet forming caulking tool for use with a caulking cartridge having a conical plastic nozzle said tool comprising:

(a) a conical body member terminated at its larger end with means to retain said caulking tool on said plastic nozzle and at its smaller end with a partial closure;

(b) a fillet forming member having planar surfaces attached to said smaller end; and said planar surfaces of said forming member lying essentially on the centre line of said conical body member;

(c) an orifice in said closure of said body member immediately beneath said surface of said fillet forming member;

wherein said fillet forming member is a flexible resilient triangular member having two edges at approximately forty five degrees to the said centre line of said body member and a third edge substantially at right angles to said centre line of said body member.

2. A fillet forming caulking tool as claimed in claim 1 wherein said means to retain said caulking tool on said plastic nozzle comprises a flange formed at said larger end of said body.

3. A fillet forming caulking tool as claimed in claim 1 wherein said body member tapers from its larger end to a smaller end at about 2½°.

4. A fillet forming caulking tool as claimed in claim 2 wherein the internal diameter of said body at said larger end is approximately 0.625 inches.

5. A fillet forming caulking tool as claimed in claim 1 wherein said means to retain said caulking tool on said cartridge comprises an externally threaded extension at said larger end shaped to threadably engage an internally threaded orifice in said plastic nozzle.

6. A fillet forming caulking tool for use in association with a caulking cartridge having a conically tapered plastic nozzle, said tool designed to produce a fillet of caulking material in a joint between two adjacent surfaces lying at an angle of less than 180° with respect to each other said tool comprising:

(a) a conical body member terminated at its larger end with an outwardly extending flange;

(b) a fillet forming member having planar surfaces attached to the smaller end of said conical body member, a surface of said fillet forming member lying essentially on the centre line of said conical body member;

(c) the smaller end of said conical body member being closed on each side of said fillet forming member but having an orifice adjacent a surface of said fillet forming member;

wherein said fillet forming member is a flexible resilient scraper of essentially triangular form having two edges at approximately forty five degrees to said centre line of said conical body member with the junction of said two edges forming an apex lying on said centre line, said apex being truncated to provide a curved fillet forming edge slightly beyond the smaller end of said conical body member and a third edge at approximately ninety degrees to said centre line whereby said two edges engage said adjacent surfaces being joined during operation.

7. A fillet forming tool as claimed in claim 6 wherein said conical body member resiliently engages said plastic nozzle to produce an essentially fluid tight conical seal when pressed over said nozzle when in use.

8. A fillet forming tool as claimed in claim 6 wherein the surfaces being joined lie at approximately ninety degrees with respect to each other and the two edges of said fillet forming member engage the surfaces being joined to remove any caulking compound from said surfaces and force it down into the fillet where it is shaped by said curved fillet forming edge.

9. A fillet forming caulking tool comprising a caulking cartridge having a conically tapered plastic nozzle and a removeable forming tool having;

(a) a conical body member terminated at its larger end with means to retain said forming tool on said plastic nozzle and at its smaller end with a partial closure;

(b) a fillet forming member having a planar surface attached to said smaller end; the planar surface of said forming member lying essentially on the centre line of said conical body member;

(c) an orifice in said body member immediately beneath said surface of said fillet forming member;

wherein said planar member is a flexible resilient triangular member having two edges at approximately forty five degrees to the said centre line of said body member and a third edge substantially at right angles to said centre line of said body member.

10. A fillet forming caulking tool including a caulking cartridge having a conically tapered plastic nozzle and a removeable forming tool for forming a fillet of caulking material in a joint between two adjacent surfaces lying at an angle of less than 180° with respect to each other said forming tool comprising:

(a) a conical body member terminated at its larger end with an outwardly extending flange;

(b) a planar fillet forming member attached to the smaller end of said conical body member, a surface of said fillet forming member lying essentially on the centre line of said conical body member;

(c) the smaller end of said conical body member being closed on each side of said planar fillet forming member but having an orifice adjacent a surface of said planar fillet forming member;

wherein said planar fillet forming member is a flexible resilient scraper of essentially triangular form having two edges at approximately forty five degrees to said centre line of said conical body member with the junction of said two edges forming an apex lying on said centre line, said apex being truncated to provide a curved fillet forming edge slightly beyond the smaller end of said conical body member and a third edge at approximately ninety degrees to said centre line whereby said two edges engage said adjacent surfaces being joined during operation.

* * * * *